United States Patent [19]

Fray et al.

[11] 4,292,147

[45] Sep. 29, 1981

[54] ZINC CHLORIDE ELECTROLYSIS

[75] Inventors: Derek J. Fray, Trumpington; Bernard K. Thomas, Pelsall near Walsall, both of England

[73] Assignee: National Research Development Corporation, London, England

[21] Appl. No.: 161,644

[22] Filed: Jun. 20, 1980

[30] Foreign Application Priority Data

Jun. 22, 1979 [GB] United Kingdom ..... 21893/79

[51] Int. Cl.[3] ..... C25C 1/16

[52] U.S. Cl. ..... 204/118

[58] Field of Search ..... 204/117, 118, 114

[56] References Cited

FOREIGN PATENT DOCUMENTS 1109905 6/1961 Fed. Rep. of Germany ..... 204/118

OTHER PUBLICATIONS

"Zn Deposit Structures Obtained from Synthetic $ZnCl_2$ Electrolyte", by D. J. Mackinnon et al., J. Applied Electrochem. 9(1979), pp. 603–613.

"Electrolysis of $ZnCl_2$ Solutions", by A. F. Nikiforov et al., Electrometallurgy of Chloride Solution, ed. Stender, Consultants Bur. N. Y. 1965, pp. 117–125.

"Zn Electrowinning from Chloride Electrolyte", by D. J. Mackinnon et al., Soc. of Mining Engineers of AIME pre-print 80-40, AIME meeting Las Vegas, Feb. 24–28, 1980, pp. 1–27.

*Primary Examiner*—R. L. Andrews

*Attorney, Agent, or Firm*—Cushman, Darby & Cushman

[57] ABSTRACT

Electrolysing an aqueous solution of zinc chloride or cadmium chloride of a concentration of 15–35 weight % at pH 2–3.5 below 35 C with gas agitation at a current density exceeding 1000 A/m$^2$, whereby coherent zinc or cadmium is yielded at the cathode.

11 Claims, 1 Drawing Figure

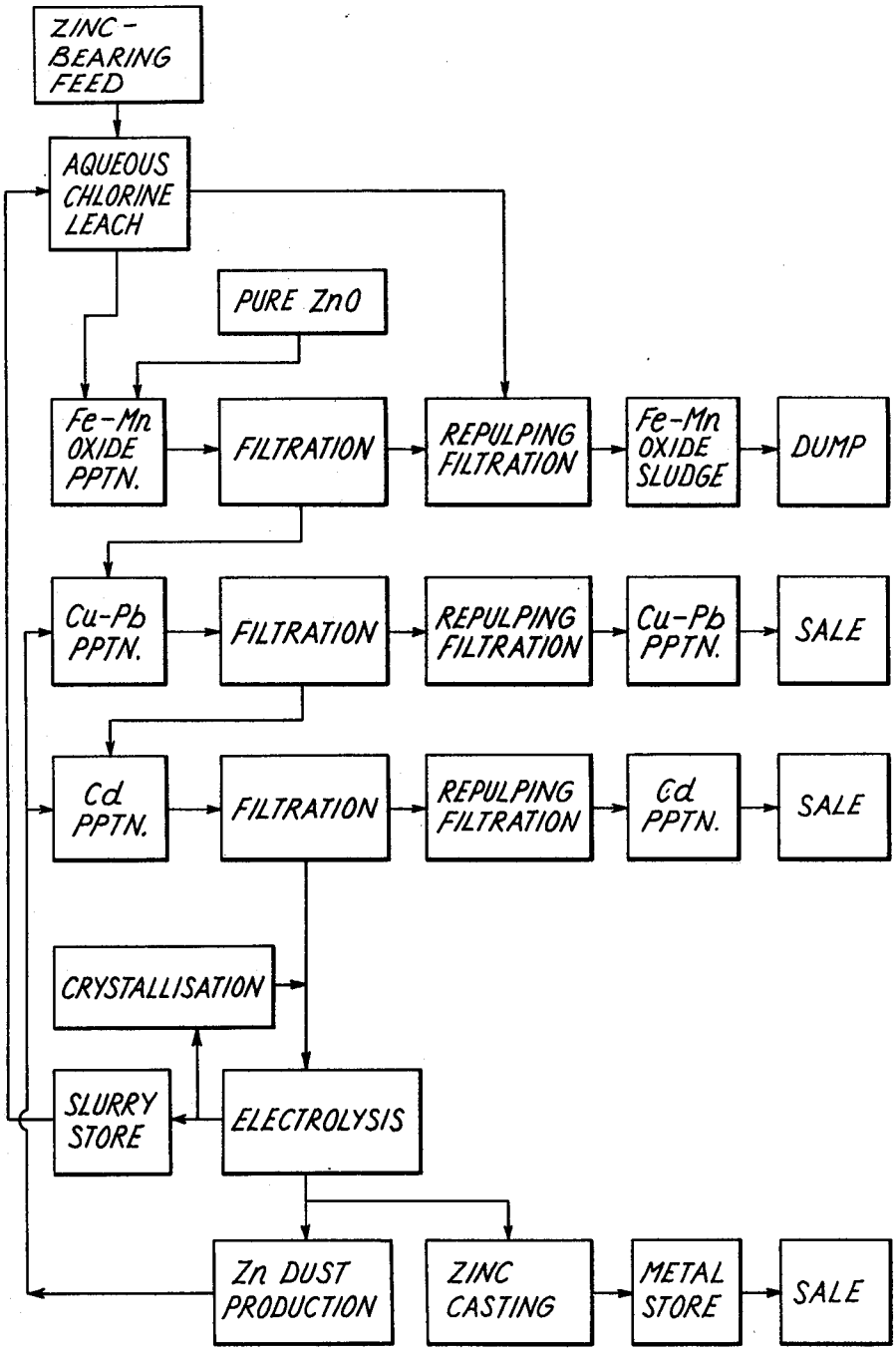
ZINC-BEARING FEED
AQUEOUS CHLORINE LEACH
PURE ZnO
Fe-Mn OXIDE PPTN.
FILTRATION
REPULPING FILTRATION
Fe-Mn OXIDE SLUDGE
DUMP
Cu-Pb PPTN.
FILTRATION
REPULPING FILTRATION
Cu-Pb PPTN.
SALE
Cd PPTN.
FILTRATION
REPULPING FILTRATION
Cd PPTN.
SALE
CRYSTALLISATION
SLURRY STORE
ELECTROLYSIS
Zn DUST PRODUCTION
ZINC CASTING
METAL STORE
SALE

ZINC CHLORIDE ELECTROLYSIS

This invention relates to electrolysis of aqueous zinc chloride or cadmium chloride, to obtain coherent elemental zinc or cadmium.

For ease of description, the invention will be described in relation to zinc.

Steel scrap when treated in an electric arc furnace gives rise to by-products including typically low-grade zinc oxide, together with copper, tin and lead oxides. Secondary copper smelters yield a fume or residue containing similar materials. When these materials are leached with sulphuric acid and electrolysed, the tin causes a drop in ampere efficiency at the cathode. In the pyrometallurgical route, the tin is transferred to the zinc and is damaging to the mechanical properties of zinc.

Some sources of zinc, such as foundry flux residues, contain chloride and if used directly in a zinc sulphate electrolytic cell the halides attack the anode. A chloride route for zinc recovery would therefore be desirable. However, leaching zinc-bearing scrap, residue or oxidic ore with hydrochloric acid is slow and wasteful, and would also leach out iron and aluminium.

We therefore propose in UK patent application 7921892 to leach zinc out of material containing it using an aqueous substantially saturated chlorine solution, preferably in the presence of chlorine hydrate. The product is a zinc chloride solution, and the present invention seeks to win the zinc from this solution (or indeed the zinc or cadmium from any aqueous solution of their chloride).

According to the present invention, an aqueous solution of zinc chloride or cadmium chloride below 35° C. at pH 2–3.5 of a concentration of 15–35 weight % is electrolysed with gas agitation at a current density exceeding 1000 $A/m^2$ to yield coherent zinc or cadmium at the cathode.

The solution obtained from the chlorine hydrate leaching is a chloride solution, containing, apart from the desired zinc ion, impurity metals such as some iron, tin, manganese, copper, lead and cadmium. This chloride solution is relatively easy to purify, for example by treatment with zinc oxide dust and chlorine to precipitate iron and manganese oxides, and by treatment with zinc dust to precipitate copper, tin, lead and cadmium. Unlike hydrochloric acid leaching, any aluminium present is oxidised to insoluble aluminum oxide by the chlorine hydrate leachant. Similarly, the strongly oxidising conditions in the leachant prevent the dissolution of iron oxide.

In subsequent electrolysis of the resulting aqueous zinc chloride the electrolyte may contain up to 20 weight % of the chloride salts of Group I or of ammonia, without affecting the zinc electrowinning process, but with considerable lowering of the working cell voltage. The conductance of the electrolyte can reach six times that obtainable with zinc sulphate.

The zinc chloride concentration may be from 15 to 35 weight percent, preferably from 20 to 30 weight percent, most referably from 24 to 26 weight percent. Above and below this range hydrogen evolution at the cathode may become considerable at the high operating current densities. In addition, the electrolyte may accommodate up to 15 gms/liter of Group II cations without undue effect on zinc electrowinning. The electrolyte pH must lie between pH2 and pH3.5.

This electrolyte may be used in an electrowinning cell operating at current densities exceeding 2500 $Am^{-2}$, at least six times the current densities used in commercial zinc sulphate cells and still yielding a coherent product. The anode reaction is the formation of chlorine hydrate (or, above 9 C at 1 atmosphere, evolution of chlorine gas). The chlorine hydrate is held as a slurry in the electrolyte and can be pumped, rather than having to collect a gas. It is also advantageous that the $ZnCl_2$ solution has a low viscosity and is readily pumped.

The temperature of the electrolyte must not exceed 35° C. to avoid degradation of the zinc deposit, but the cell may operate satisfactorily down to 0° C., preferably not exceeding 9° C., conveniently 5°C. -9° C.

Under these operating conditions the electrolyte may contain up to 100 mg/liter of high molecular weight proteinaceous additive (MW$\gtrsim$50 000) such as gum arabic. Gas sparging of the electrolyte may be used to effect the necessary vigorous agitation of the electrolyte. The sparging gas may be air, nitrogen or oxygen without detriment.

The cathode blank material may be aluminium, or an aluminium alloy. The anode may be for example graphite, or $RuO_2$ or $LaO_2$ or platinum on a titanium base, a so-called Dimensionally Stable Anode (D.S.A.) The current may be intermittently reversed in the cell (so-called periodic current reversal). Suitable conditions may be a forward:reverse time of 15:1.

The cell may be separated into anode and cathode compartments with a porous diaphragm which prevents solid chlorine hydrate from passing from the anode, where it is formed and where it may reach a concentration up to 0.02 M in chlorine, to the cathode. This chlorine hydrate may advantageously be recycled to the leaching stage described in our said Patent Application, and, as a material, chlorine hydrate slurry is relatively convenient to handle. The spent electrolyte may be crystallised to remove such salts as Group I and II chlorides, which may accumulate to excess in the electrolyte, and after purification by this crystallisation the electrolyte is recycled to the electrolysis.

The invention will now be described by way of example with reference to the accompanying drawing, which is a flow-chart of a zinc recovery scheme utilising the invention.

EXAMPLE 1

Rotherham flue dust is a zinc ferrite containing 30.4% Fe, 21.4% Zn, 8.2% Pb, 2.6% Mn, 4.3% CuO, 3.6% $SiO_2$, 1.39% Na, 1.00% K and 0.58% S. (Crushed and ball-milled zinc oxide ores behaved quite similarly). The as-received flue dust has a particle size of 0.7 microns.

The flue dust was leached with a slurry of chlorine hydrate prepared at 1 atmosphere in distilled water. The total chlorine concentration was 0.03 moles/liter and the leaching temperature was 3.5° C.

After 90 minutes of leaching, 92% of the zinc had been extracted, but only 6.8% of the iron. This is about an order of magnitude faster than conventional (sulphuric) leaching. Alkali metals and lead are extracted with 100% efficiency.

Since, for ultra-pure zinc, the concentration of metals more noble than zinc must be below 1 part per million of the zinc in the solution which will be electrolysed to obtain the desired zinc at the cathode, the lead (and other such impurities, e.g. copper and cadmium) is removed by cementation with zinc dust at 120° C. Any iron and manganese which are leached out are precipitated (by displacement) as their oxides by treatment with ZnO and chlorine at 120° C.

The resulting solution was filtered and made up to 20 weight % of $ZnCl_2$, and 10 weight % $NH_4Cl$ were added to improve the conductivity (which became about 0.16 $ohm^{-1}cm^{-1}$). Impurities in parts per million were, after this treatment, less than: Sb 1.6, Cu 0.16, Co 0.32, Fe 1.6, Pb 0.64, Mn 0.64 and Ti 0.32.

The solution was electrolysed in a cell having an aluminium cathode and a platinised titanium anode separated by an asbestos diaphragm. The cell was kept at a temperature of 5° C. Chlorine hydrate evolved at the anode (which, unlike graphite, survives this) floated to the top of a slurry store containing also zinc chloride and was removed, for recycling to the leaching stage. In order to improve the quality of the deposit, air sparging was used to ensure vigorous agitation of the electrolyte, and 40 mg/l of gum arabic were added to the electrolyte. 10 mg/l KF were also added so as to improve adherence.

The cell was run at a current density of 2700 A per square meter of cathode, requiring 3.95 V and recovering zinc with a current efficiency of 85%. By operating the cell under conditions of periodic current reversal the cathodic current efficiency was increased to 92% at a current density of 3020 A per square meter of cathode. In this case the forward time/reverse time was twenty-/one seconds.

The purity of the cathodic zinc was 99.99%. Zinc dust, made by distilling and condensing the zinc, was recycled to the lead etc. cementation stages, and the rest made up for sale.

EXAMPLE 2

A commercial zinc die cast alloy to BS1004A has the composition 4.3% Al, <0.01% Cu, 0.045% Mgr, 0.1% Fer, 0.007 % Pb, 0.005% Sn.

A sample of this alloy was leached with a 10 weight % zinc chloride solution at 4° C. containing chlorine hydrate slurry. The chlorine (neglecting $Cl^-$ from the zinc chloride) was 0.025 moles per liter. The zinc was leached from the alloy at a rate of 0.402 mg per square centimeter per minute. After seven hours of leaching, the zinc chloride solution contained 12 ppm Al and 8 ppm Fe from the alloy as the major impurities.

Following purification with zinc dust as before, electrolysis of the solution resulted in the electrowinning of zinc of 99.99% purity at the cathode.

We claim:

1. A process for electrolysing an aqueous solution of zinc chloride having a concentration of 15–35 weight %, the solution arising from leaching a zinc-containing material using an aqueous substantially saturated chlorine solution, the electrolysis proceeding at pH 2–3.5 below 35° C. with gas agitation at a current density exceeding 1000 $A/m^2$, thereby yielding coherent zinc at the cathode.

2. Electrolysing according to claim 1, wherein the leaching was conducted in the presence of chlorine hydrate.

3. Electrolysing according to claim 1, wherein the solution being electrolysed contains up to 20 weight % of the chloride salts of Group I or of ammonia.

4. Electrolysing according to claim 1, wherein the concentration of the zinc chloride in the aqueous solution is from 20 to 30 weight %.

5. Electrolysing according to claim 4, wherein the said concentration is from 24 to 26 weight %.

6. Electrolysing according to claim 1, wherein the current density exceeds 2500 $A/m^2$.

7. Electrolysing according to claim 1, wherein the current is intermittently reversed.

8. Electrolysing according to claim 1, at a temperature not below 0° C.

9. Electrolysing according to claim 1, at a temperature not exceeding 9° C.

10. Electrolysing according to claim 9, at a temperature of 5°–9° C.

11. Electrolysing according to claim 9, wherein chlorine hydrate formed at the anode is sent to leach zinc from a zinc-containing material.

* * * * *